United States Patent [19]

Feldmann et al.

[11] Patent Number: 4,751,955

[45] Date of Patent: Jun. 21, 1988

[54] FEEDING A MOLD FOR CONTINUOUS CASTING OF METAL

[75] Inventors: Franz Feldmann, Krefeld; Fritz-Peter Pleschiutschnigg, Duisburg, both of Fed. Rep. of Germany

[73] Assignee: Mannesmann AG, Duesseldorf, Fed. Rep. of Germany

[21] Appl. No.: 906,595

[22] Filed: Sep. 9, 1986

Related U.S. Application Data

[63] Continuation of Ser. No. 670,626, Nov. 13, 1984, abandoned.

[30] Foreign Application Priority Data

Nov. 11, 1983 [DE] Fed. Rep. of Germany ..... 3340844

[51] Int. Cl.[4] ..... B22D 11/07; B22D 11/00

[52] U.S. Cl. ..... 164/268; 164/439; 164/461

[58] Field of Search ..... 164/472, 473, 488, 439, 164/268, 461

[56] References Cited

U.S. PATENT DOCUMENTS

| | | | |
|---|---|---|---|
| 3,414,043 | 12/1968 | Wagner | 164/461 |
| 3,457,984 | 7/1969 | Yoshida et al. | 164/461 |
| 3,460,609 | 8/1969 | Olsson | 164/472 X |
| 3,834,447 | 9/1974 | Luchok et al. | 164/439 X |

FOREIGN PATENT DOCUMENTS

| | | | |
|---|---|---|---|
| 930927 | 7/1973 | Canada | 164/472 |
| 1290962 | 3/1962 | France | 164/472 |
| 56-163063 | 12/1981 | Japan | 164/488 |

*Primary Examiner*—Kuang Y. Lin
*Attorney, Agent, or Firm*—Ralf H. Siegemund

[57] ABSTRACT

The utilization of a feeder immersion type pipe for continuous casting is avoided through an antechamber-like feeder vessel on top of the mold for continuous casting, having a short extension that reaches into the mold cavity and defines a step towards the wall proper from which steel flows in widening cross section to directly form the casting strand. Casting extraction is enhanced by feeding appropriate material, either fluid or a foil, into the space of the mold cavity immediately underneath this step.

2 Claims, 5 Drawing Sheets

FEEDING A MOLD FOR CONTINUOUS CASTING OF METAL

This application is a continuation of Ser. No. 670,626, filed Nov. 13, 1984, now abandoned.

BACKGROUND OF THE INVENTION

The present invention relates to a mold for continuous casting of metal, particularly steel, under inclusion of a cooling arrangement, and using a separate uncooled supplemental part which is fastened to the charge end or inlet of the mold.

Molds with particular uncooled charge and inlet structure are know, and they provide for the flow control of the molten metal into the mold without losing any heat, at least not to any significant extent. The supplemental inlet or charge part of course has to be of sufficient thermal insulation, i.e., it must provide in fact a barrier against heat loss from the molten material in order to obtain a pouring flow into the mold at a particular casting temperature so that precipitation, bubbles, cavities, or the like will not be produced.

Another purpose of such a supplemental charge element is the replacement of so-called injection or immersion tubes or pipes. The supplemental charge element is made of ceramic. graphite, or a suitable blend of high temperature resistant material. The utilization of a charge tube or immersion pipe in a mold for continuous casting does permit a reoxidation of the molten material, particularly as far as the metal is concerned as it flows through the pipe. On the other hand, these immersion type casting pipes or tubes are subject to a natural wear which is significant. Moreover, they cause certain precipitation of clay substances in the molten material so that in fact certain remnants so to speak of the casting pipe can be found in the continuous casting and ingot. This of course reduces the quality of the cast metal, which is particularly noticeable and detrimental in case of steel. Therefore, in order to avoid such inclusions, and to ensure a high quality casting texture, one needs several supplemental features in order to make immersion casting pipes and injection tubes for charging a mold feasible; the supplemental features of course have a cost increasing factor as far as the making of the steel product is concerned.

A particular problem concerning durability of casting pipes, charge nozzles, or the like, particularly when they have their ends immersed in the molten steel bath, will occur when casting ingots of fairly thin dimensions, i.e., a casting having a thickness of less than 100 mm. These problems increase with width of the casting.

German printed patent application No. 2,056,532 discloses charging a mold for continuous casting under avoiding of a casting pipe using instead a funnel-shaped additive being coupled to the mold through a fireproof coupler, such that the casting area of the coupler is in fact a continuation of the interior of the mold proper. The opening of the fireproof coupler is provided with an enlargement as an entrance which matches the funnel-shaped feeder supplement. The mold with attachments, coupler, etc., oscillates during casting, but still it was found that this configuration in some form impedes the cooling of the cast material, the formation of a skin, and separation of the casting as it emerges from the mold.

In accordance with another proposal disclosed in German printed patent application No. 1,458,121, corresponding to U.S. patent application Ser. No. 286,349, filed June 7, 1963, in the name of George Robert Gardner, the entrance of the mold for continuous casting is enlarged and an annular insert is tensioned against the front face of the mold. This way one obtains inherently an extension of the insert in radial inner direction, i.e., one obtains a kind of rim above the upper edge of the mold's cavity. The immersion and feeder pipe for this machine ends in the area of that annular insert. This kind of configuration favors indeed flow of the metal from the precooled section established by this annular insert, the flow to occur particularly along the inner wall of the mold proper and the cooling portion thereof. Nevertheless it was found that favorable cooling conditions are not established in such a manner, but they are required particularly for casting of steel. In this sense then this particular suggestion lacks a separation zone for that portion of the casting which has already a somewhat solidified and strengthened skin. Since adequate separation is not ensured, certain inhomogenities in the texture of the casting become more or less unavoidable.

DESCRIPTION OF THE INVENTION

It is an object of the present invention to improve cooling, and particularly cooling conditions in the entrance area of a mold for continuous casting under utilization of an uncooled feeder portion to be used as supplement whereby particularly requirements inherent in continuous casting are met in such a manner that thin and very wide cast ingots, i.e., flat slab ingots, can indeed be met.

In accordance with the preferred embodiment of the present invention it is suggested to provide a supplemental feeder and charge vessel to be placed on top of a mold for continuous casting such that an extension reaches to some extent into the casting opening of the mold, and in the lower end it provides a peripheral step in relation to the mold wall. The section of the supplemental part reaching into the mold for continuous casting runs in fact the molten metal directly towards the cooled mold wall, whereby not only a flow separation edge is provided, but also a defined zone of cooling in which the casting forms a skin, which will separate from the mold wall somewhat downstream. This step portion of the insert may be provided with several steps in outward direction to obtain a more continuous transition from insert to mold wall. On the other hand, a separate immersion type feeder pipe is obviated. The inventive added-on part is therefore quite suitable for thin casting cross sections, or for thin and wide type cross sections, even if the part begins to wear.

In addition, it is suggested that in the range of the steps, certain supplemental material (fluid) can be provided to enhance the extraction of the casting. Such enhancement material will also improve the conditions under which the casting separates from the wall. Moreover, these additives may even protect the casting against reoxidation. In furtherance of the invention, it is therefore suggested to provide through the wall of the supplemental element, or through the mold wall itself, or both, pressurized lubricants such as inert gases, carbon, casting powder, flux, or the like. Herein it is of advantage to provide feeder pipes for these casting enhancing materials which will reach the interior in the interface between the step and the mold. This particular location is favored from the point of view of radial as well as axial geometry, so that indeed the additive will lodge between the casting and mold wall.

The separation of the casting under protection against reoxidation and support of this thin skin will also obtain if the extraction enhancing material is, for example, a foil which is continuously fed between the feeder element at the mold wall. This foil may either be aluminum or a steel strip. Providing the foil with a nickel cover enhances the surface thereof. The foil may be of a multi-ply configuration having a layer facing the mold wall which is provided for lubrication while the layer facing the casting has certain adhesive properties. It may be of advantage moreover to provide such foil feeding separately on each of the mold walls.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now to the detailed description of the drawings, FIG. 1 illustrates a tundish or casting ladle 2 or the like, holding a pool or bath of molten metal such as steel 1. The vessel 2 is of relatively thick wall construction and is made of refractory material, or at least with a refractory lining. A charging stream 3 pours from the bottom opening of the vessel 2, there being a plug or stopper **2*a* provided by means of which this opening can be closed. The stream of molten metals 3 pours into supplemental feeder vessel or container 4 constructed in accordance with the preferred embodiment of the present invention, and being, so to speak, an antechamber or feeding vessel for a mold 5 for continuous casting of a casting strand, casting, or ingot 7. The two elements 4 and 5** are physically firmly interconnected, and they oscillate together as a unit. Oscillating a mold is usual procedure, and details thereof are not shown.

Figure 2:
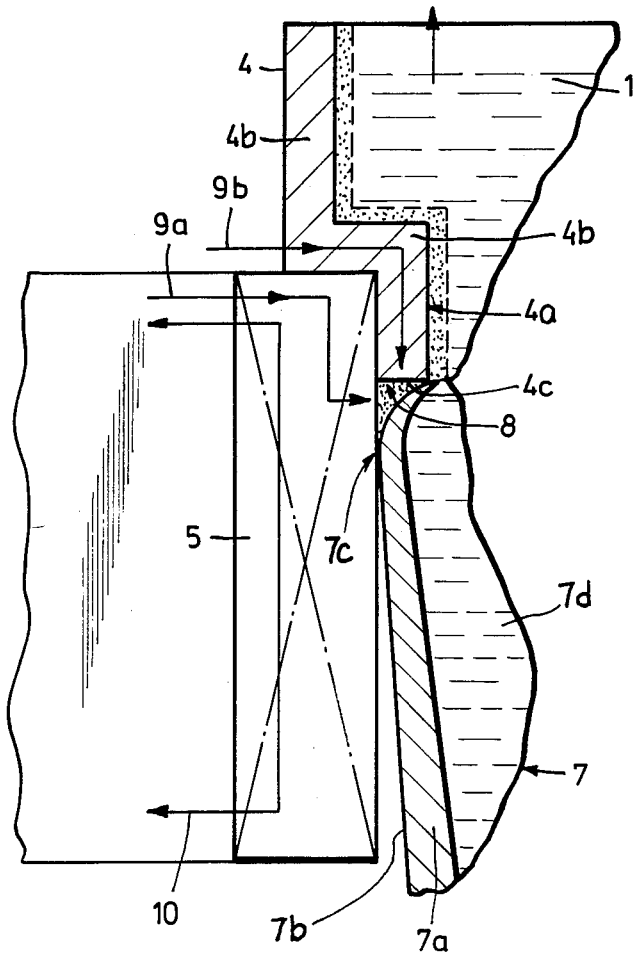
FIG. 2 is a partial section on an enlarged scale showing basically the same device as shown in FIG. 1, but under inclusion of further details.

The mold 5 is as such constructed in a conventional fashion, and is provided in its interior portion as far as the mold walls are concerned, with facilities for cooling of the mold with water or other cooling medium. These cooling ducts 10 are schematically shown in FIG. 2. On the other hand, the feeder vessel 4 is not cooled and made of fireproof or refractory material.

The feeder vessel 4 has in its bottom portion an extension **4*a* of tubular configuration, and reaches into the opening 5*a* of the mold. The lower end of this extension 4*a* is a annular surface providing in fact a step 4*c* from the interior of the extension 4*a* to the correspondingly recessed receded mold walls 5*b* and 5*c*. The metal pours from the vessel 4 continously through the extension 4*a*, and the reference numeral 7*b* denotes the outer contour of that stream as it pours into the mold cavity in a curved configuration directly underneath the step 4*c* of extension 4*a*; the curved surface portion of this stream is obtained on account of the step 4*c* defined by the end of the extension 4*a*. The casting stream 7 reaches the mold wall in a zone 7*c*, from which it separates again to some extent as a solidifying or solidified skin 7*a* forms. Reference numeral 7*d* refers basically to the still liquidous core of the casting, which is in effect a kind of liquidous continuation of the flow of steel through the extension 4*a***.

Between the wall **5*b* of the mold the step 4*c* forming lower end of the extension 4*a* of charging vessel 4, and the uppermost curved surface portion of the string 7 a void is shown in FIG. 2 to be more or less filled with a fluid medium or material 8 which, generally speaking, enhances and furthers the extraction of the casting 7 from the mold. The material may be fed to this particular zone through appropriate tubing, such as schematically indicated by reference numeral 9*a* and 9*b* running through the mold wall and through the wall 4*b* of the vessel 4. The material so fed may be of a powderous nature, in which case pressure is to be applied to cause the powder to flow through these tubes 9*a* and 9*b***. A certain pressure is also needed in case this material is an inert gas.

Figure 3:
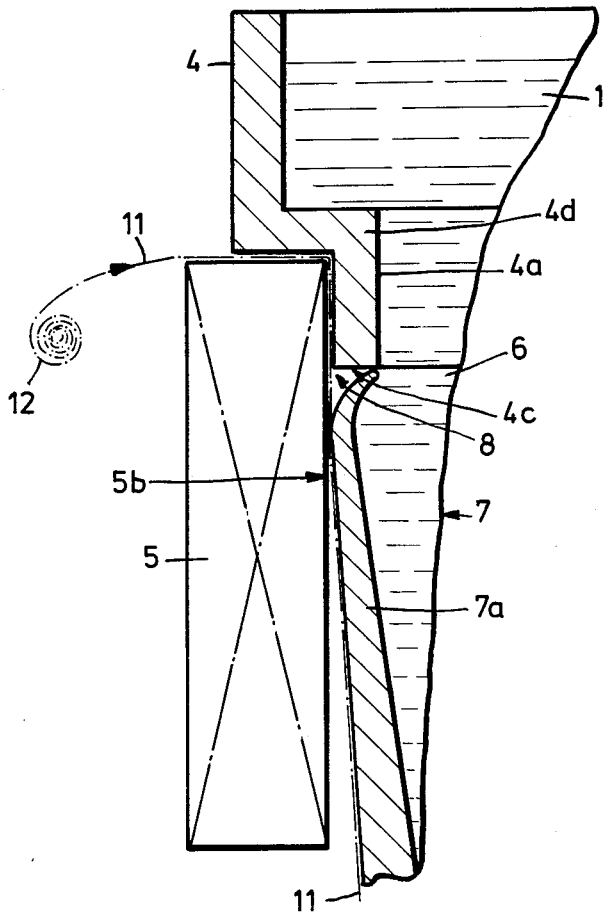
FIG. 3 is a section similar to FIG. 2, but showing the feeding of a foil for enhancement of casting extraction.

As shown in FIG. 3, in lieu of powder or a gas a foil 11 is fed through a gap between the wall **4*b* of the vessel 4, including particularly the outer wall of the extension 4*a* and the adjacent surface portions of the mold 5. A spool 12 is shown schematically for feeding this foil 11. The foil therefore will be fed along the upper portion of the mold wall 5*b* until reaching the step 4*c***.

This foil 11 may either be made of aluminum, or it may be a steel strip, and it may be provided with a nickel coating. In fact it was found that depending upon the surface properties of the foil 11, it may be possible to reduce the mold oscillation, i.e., the up and down vibration of the casting and equipment, or one may even dispense with this oscillation entirely, and can therefore save a considerable amount of equipment. In furtherance of this objective, the foil 11 should be provided with several layers in a multi-ply fashion, whereby particularly that surface layer of the foil 11 which slides along the mold wall **5*b* will may be made of Nickel and will have lubricating property, while the opposite surface layer facing the casting is made, so as to be provided with properties that enhances adhesion. The down-moving casting carries the foil along, thereby providing a kind of self-feeding action. Separate foils should be provided for each side of the more or less quadrilateral mold as far as its cross section is concerned. Four mold walls 5*b*, 5*c*, 5*d* and 5*e* are shown in FIG. 5**.

Figure 1:
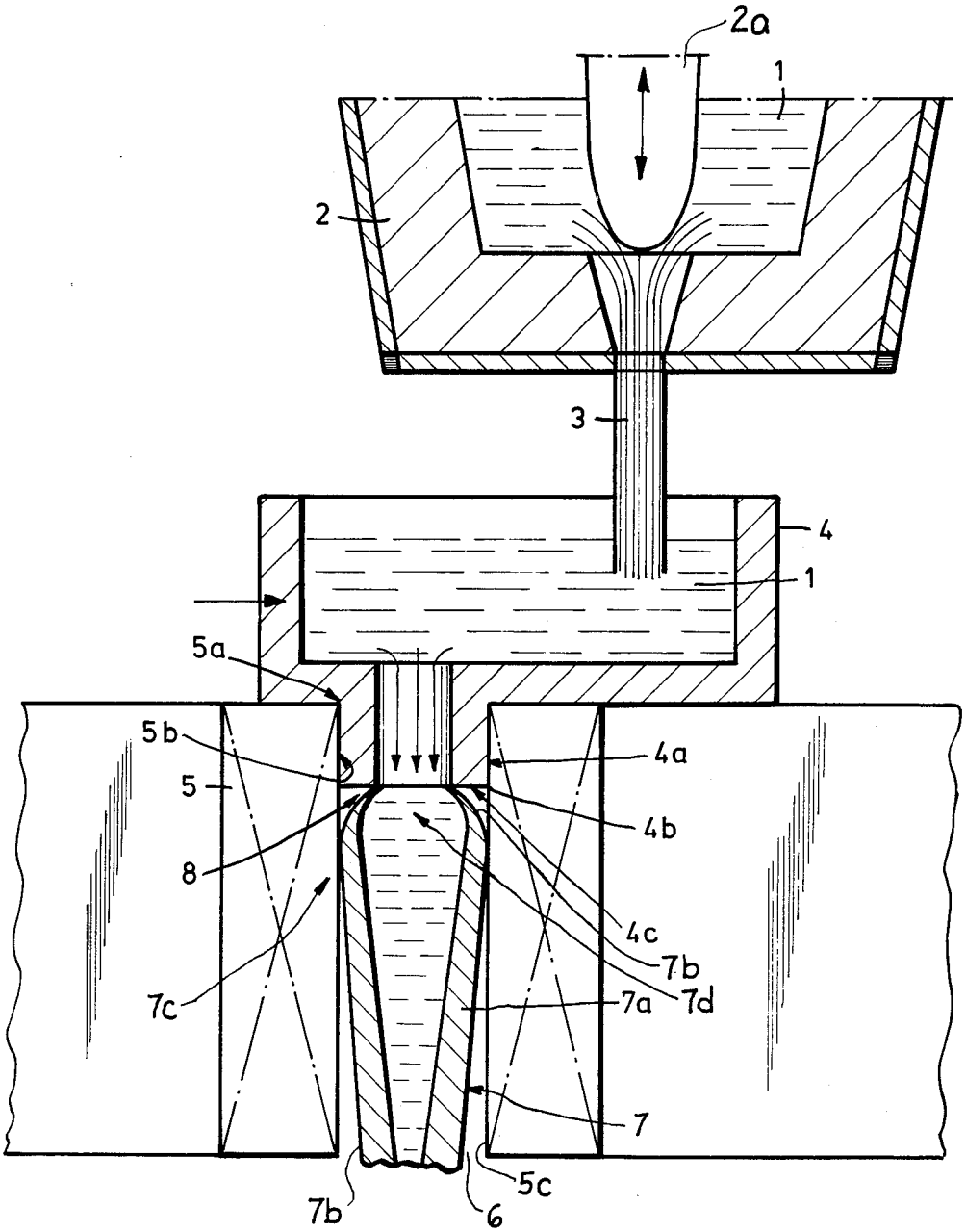
FIG. 1 is a cross section in a longitudinal direction through a machine for continuous casting a feeder element at the entrance of the mold in accordance with the preferred embodiment for practicing the best mode of the invention.
Figure 4:
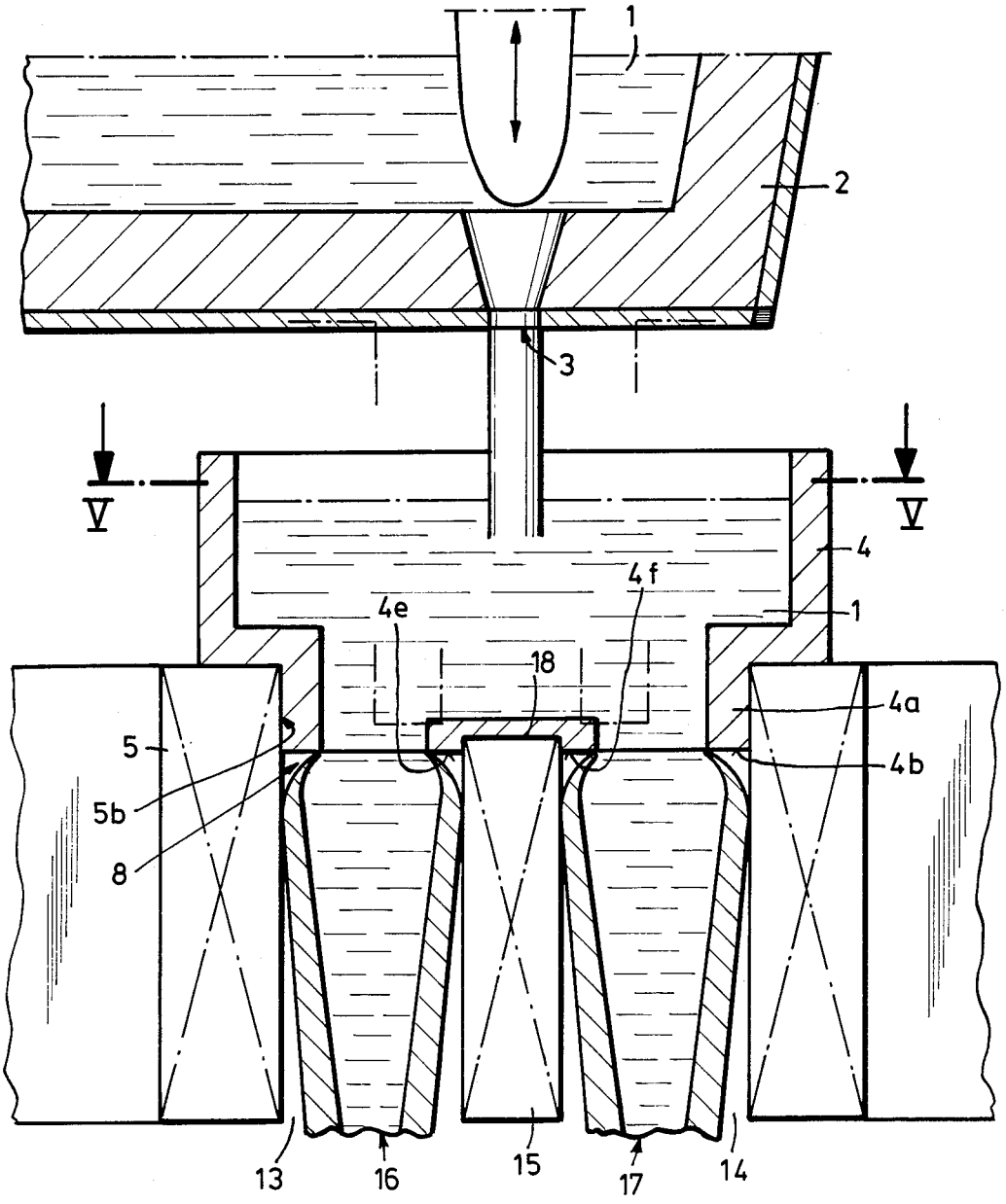
FIG. 4 shows an arrangement in a section similar to FIG. 1, but for multiple casting string operation.
Figure 5:
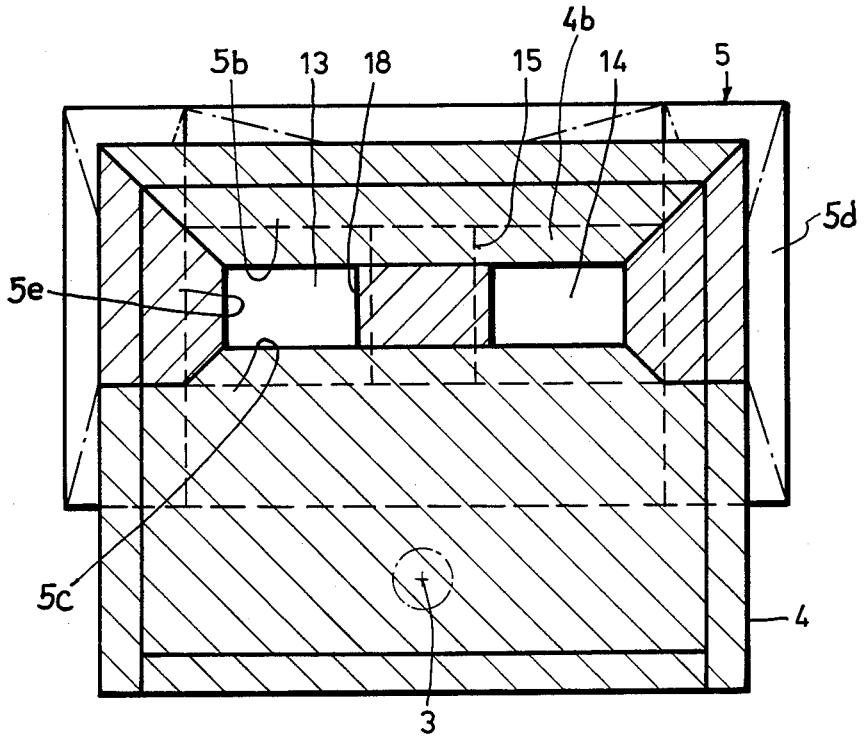
FIG. 5 is a horizontal view corresponding to section plane 5—5 in FIG. 4.

FIGS. 4 and 5 illustrate a casting machine being composed essentially similar to the one shown in FIG. 1 except that there is a double mold provided for the continuous casting simultaneously of two strings 16 and 17. The principle involved, and the construction proposed here, can be extended to cover even more than two parallel running casting operations. The mold cavity 6 of FIG. 5 is in effect divided by a partition 15 to establish in this case two casting chambers 13 and 14, so that correspondingly the narrow casting strings 16 and 17 are produced. The particular extension of **4*a* of the feeder vessel 4 is likewise partitioned by an adapting part 18 which forms analogous steps 4*e* and 4*f* and matches the partition 15 of the mold. Partition 18 covers in fact the upper part of partition 15 and constitutes also an uncooled portion of this antechamber and feeder vessel 4. Here, as earlier, of course the lack of cooling of the vessel 4** is necessary in order to avoid premature formation of any skin already inside that feeder vessel.

It can readily be seen that the configuration shown in FIGS. 4 and 5 permits in fact to cast relatively thin and less wide casting strings, as compared with a single strand casting machine, and in this case one can indeed dispense completely with any immersion feeder pipe, or the like. The feeder chamber as constructed in accordance with the invention does not only permit casting of very thin and wide cross-sectional formats and contours of steel, but one can readily change a single strand casting ino a multiple strand casting machine simply through partitioning of what is originally a single mold into plural molds. The casting vessel as such remains the same, particularly the feeder chamber requires merely the adding of parts such as 15 and 18 in FIGS. 4 and 5.

The invention is not limited to the embodiments described above, but all changes and modifications thereof not constituting departures from the spirit and scope of the invention are intended to be included.

We claim:

1. In a machine for continuous casting including a casting mold with means for internal cooling having an upper opening, a feeder structure comprising:

an uncooled feeder or charge vessel mounted to the mold and having an outlet extending into said mold, and having at a lower end of its wall a step all around the end, to establish a stepwise widening of the flow space for the molten metal from the outlet through which molten metal pours into the mold, into a mold cavity and outwardly towards the mold wall proper, said outlet not being immersed into molten steel in said mold, and being uncooled; and means for feeding a foil into said space underneath said outlet and in the mold cavity, the foil being a lubricant and is moved along the mold wall in the interior of the mold cavity.

2. The improvement as in claim 1, the foil being an aluminum foil, a steel strip, a strip with a nickel coating, or a foil with lubricating properties on one side and adhesive property on the other side.

* * * * *